US006209795B1

(12) United States Patent
Rose

(10) Patent No.: US 6,209,795 B1
(45) Date of Patent: Apr. 3, 2001

(54) CAMPING APPARATUS FOR HEATING A PORTABLE HABITATION AND METHOD

(76) Inventor: Jim E. Rose, 4287-A Beltline Rd., Suite 156, Dallas, TX (US) 75244

( * ) Notice: Subject to any disclaimer, the term of this patent is extended or adjusted under 35 U.S.C. 154(b) by 0 days.

(21) Appl. No.: 09/335,552

(22) Filed: Jun. 18, 1999

(51) Int. Cl.[7] ..... F24D 1/00
(52) U.S. Cl. ..... 237/9 B
(58) Field of Search ..... 237/52, 53, 55, 237/9 B

(56) References Cited

U.S. PATENT DOCUMENTS 4,138,985 * 2/1979 Marley ..... 126/6
4,691,688 * 9/1987 Urso ..... 126/208
4,848,310 * 7/1989 Millington ..... 126/4
4,860,726 * 8/1989 Barker ..... 126/208
5,121,739 * 6/1992 Barker ..... 126/248
5,619,935 * 4/1997 Wilson ..... 110/241

* cited by examiner

*Primary Examiner*—Harold Joyce
*Assistant Examiner*—Derek S. Boles
(74) *Attorney, Agent, or Firm*—Harry C. Post, III

(57) ABSTRACT

Camping apparatus for heating an interior of a portable habitation. The apparatus comprises an interior heater for heating the interior of the portable habitation. A heat transfer device uses fumes emitted by a fire to provide heated air. Transporting apparatus transports the heated air from the heat transfer device to the interior heater. The interior heater is disposed at a first location and the fire is disposed at a second location. The first and second locations are disposed sufficiently apart from one another to prevent the fire at the second location from spreading to the portable habitation at the first location. The transporting apparatus has a length sufficient to extend between the first and second locations.

16 Claims, 2 Drawing Sheets

CAMPING APPARATUS FOR HEATING A PORTABLE HABITATION AND METHOD

BACKGROUND OF THE INVENTION

This invention relates to camping apparatus for heating the interior of a portable habitation and, more particularly, to such camping apparatus that a fire to provide heated air to an interior heater in the portable habitation.

Hunters, explorers, geologists and other campers commonly use a portable habitation, such as a tent, for resting and sleeping. Sometimes during cold weather, these individuals find fuel, such as wood from trees, near the campsite to provide an open fire in the habitation to make themselves comfortable. Sometimes a camp stove is brought along with the habitation primarily for cooking food and secondarily for heating the habitation.

The use of an open fire in the habitation is extremely dangerous because the open fire inside can envelop the material used to make the habitation and destroy it. In which event, the people in the habitation can be injured by the ensuing fire or by the cold weather existing outside of the habitation. Also, it is extremely dangerous because an open fire inside the habitation may emit harmful or deadly gases, such as carbon monoxide, directly into the habitation. In which event, the people in the habitation can be asphyxiated.

A combination heater and catalytic converter is available to provide heat within a habitation. However, the heat generated from a catalytic converter can be sufficiently hot to cause the material of the habitation to burn. In which event, the fire could envelop the material used to make the habitation and destroy it with the people in the habitation being injured by the ensuing fire or by the cold weather existing outside of the habitation.

Accordingly, it is an object of the present invention to provide apparatus for heating the interior of a portable habitation.

Further, it is an object of the present invention to provide apparatus for heating the interior of a portable habitation that uses a fire, which is positioned away from the habitation by a distance sufficient to prevent damage to the habitation from the fire.

Further, it is an object of the present invention to provide a method of providing heat to the interior of a portable habitation.

Further, it is an object of the present invention to provide a method of providing heat to the interior of a portable habitation by using a fire that is positioned away from the habitation by a distance sufficient to prevent damage to the habitation from the fire.

BRIEF SUMMARY OF THE INVENTION

In accordance with the present invention, there is provided apparatus for heating an interior of a portable habitation. The apparatus comprises an interior heater for heating the interior of the portable habitation. A heat transfer device uses fumes emitted by a fire to provide heated air. Transporting apparatus transports the heated air from the heat transfer device to the interior heater. The interior heater is disposed at a first location and the fire is disposed at a second location, the first and second locations being disposed sufficiently apart from one another to prevent the fire at the second location from spreading to the portable habitation at the first location. The transporting apparatus has a length sufficient to extend between the first and second locations.

Further, in accordance with the present invention, there is provided camping apparatus for heating an interior of a portable habitation. The camping apparatus comprises an interior heater for heating the interior of the portable habitation, which is disposed at a first location. A heat transfer device uses fumes emitted by a fire to provide heated air. The fire is disposed at a second location. The first and second locations are disposed sufficiently apart from one another to prevent the fire at the second location from spreading to the portable habitation at the first location. The heat transfer device includes a chimney to transport fumes emitted by the fire away from the fire. The chimney includes a center that is constructed with sidewalls tapering toward one another away from the fire. A plurality of fins for transferring heat from the fumes is connected to and extends away from the chimney. Each of the plurality of fins is constructed to have a curved surface for urging the air being heated into a flow around the chimney. A sleeve containing a quantity of air detachably is connected to and disposed around the chimney outwardly of the fins. The sleeve includes an interior to contain the quantity of air. An air inlet for allowing the quantity of air to be continuously supplemented is disposed in fluid communication with the interior. A heated air outlet for allowing the quantity of air to be continuously exhausted is disposed in fluid communication with the interior. Transporting apparatus transports the heated air from the heat transfer device to the interior heater. The transporting apparatus has a length sufficient to extend between the first and second locations and an elongated tube connected to the heated air outlet of the sleeve. A burner providing a continuous fire is fed by fuel supplied by a fuel tank. A connector connects the burner to the heat transfer device and includes positioning apparatus for centering the burner relative to the center of the chimney. The positioning apparatus has at least three screw members threadedly connected to and disposed to extend inwardly to engage the fuel tank.

Further, in accordance with the present invention, there is provided a method of providing heat to an interior of a portable habitation. The method comprises the steps of choosing a first location to place the portable habitation. The minimum distance from the first location where a fire may be used outside of which the fire may be used that will not spread to the portable habitation is determined. A fuel tank is positioned at a second location chosen outside of the minimum distance. A burner is attached to the fuel tank. A chimney is mounted over the burner. One end of a transporting apparatus is connected to the sleeve and another end of the transporting apparatus is connected to a heat transfer device in the portable habitation. A fire is started on the burner and air is passed through the sleeve while fuel is being burned by the burner.

BRIEF DESCRIPTION OF THE SEVERAL VIEWS OF THE DRAWING

Objects and advantages of the invention will become apparent upon reading the following detailed description and upon reference to the drawings, wherein like reference characters are used throughout to designate like parts.

DETAILED DESCRIPTION OF THE INVENTION

Figure 1:
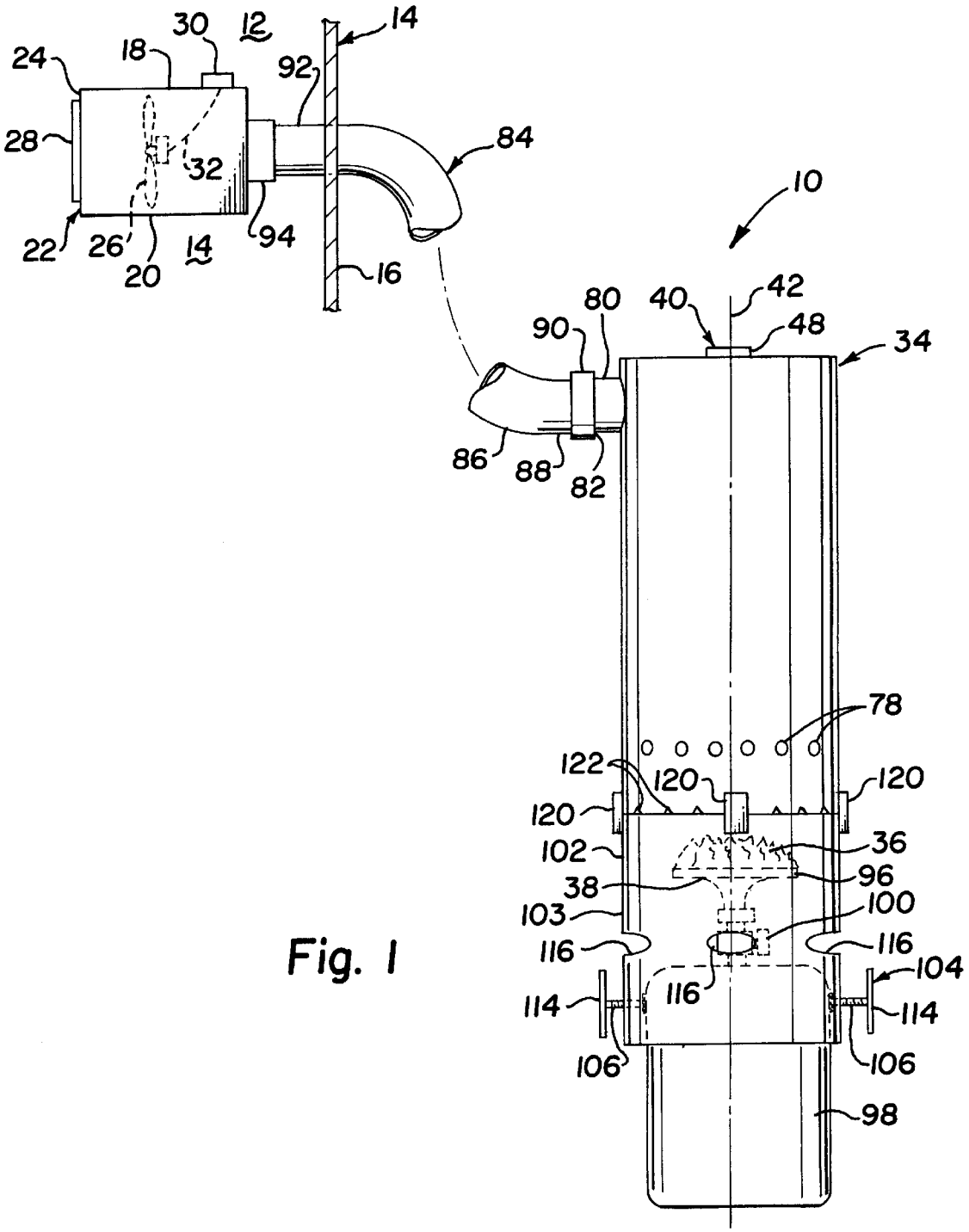
FIG. 1 is a view of the components of a camping apparatus constructed according to the present invention.

Turning now to FIG. 1 of the drawing, there is shown a camping apparatus 10 for heating an interior 12 of a portable habitation 14. The portable habitation is of conventional construction, such as a tent having four or more walls 16 made from a conventional material, such as canvas, that may be with or without a floor (not shown).

An interior heater 18 is provided for heating interior 12 of portable habitation 14. Interior heater 18 is disposed at a first location 20 and is constructed in a box 22 configuration with a plurality of walls 24 enclosing an electrical motorized fan 26. Fan 26 forces heated air from the inside of box 22 through louvers 28 into interior 12 and is regulated by a conventional thermocouple 30 or similar conventional device connected by a conventional electrical operating circuit 32.

Figure 2:
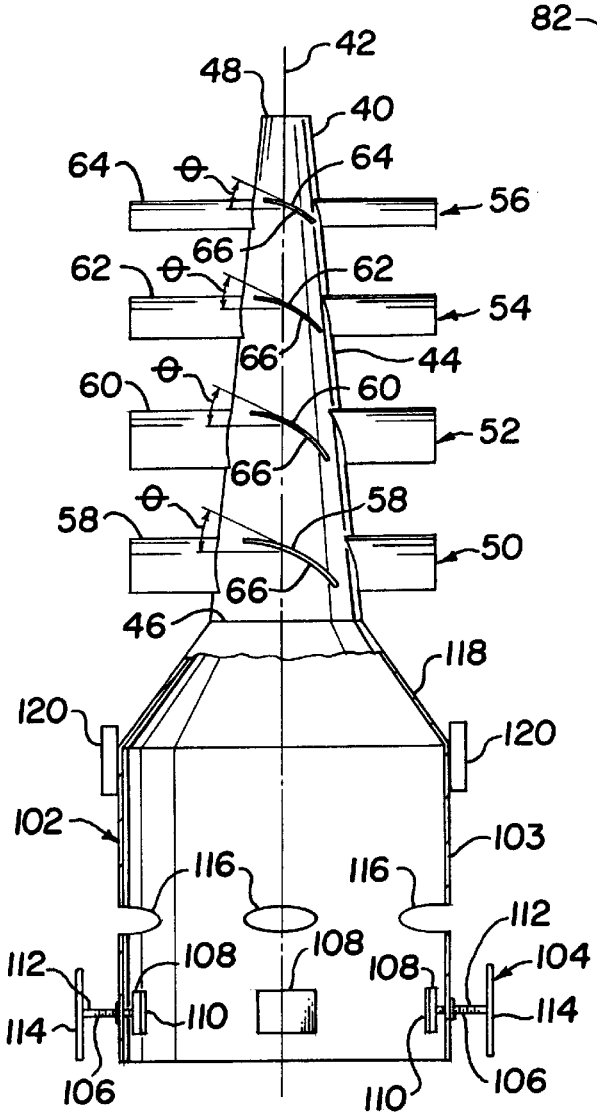
FIG. 2 is a view, in elevation and partly in section, of a heat transfer-connector of the apparatus shown in FIG. 1.

A heat transfer device 34 uses fumes emitted by a fire 36 to provide heated air. The fire 36 is disposed at a second location 38. As best seen in FIGS. 1 and 2, first location 20 and second location 38 are disposed sufficiently apart from one another to prevent the fire at second location 38 from spreading to portable habitation 14 at first location 20.

Heat transfer device 34 has a chimney 40 for transporting the fumes emitted by fire 36 away from fire 36. Chimney 40 has a center 42, which is preferably an axis of symmetry, and is constructed with sidewalls 44 tapering toward one another the further chimney 40 is away from fire 36. Thus, chimney 40 has the general shape of a truncated cone with fire 36 being disposed at a base 46 of the cone and the truncated portion 48 of the cone forming the outlet for the fumes from fire 36. Chimney 40 has a height sufficient to prevent fire 36 from passing outwardly of heat transfer device 34 into the surrounding area.

Extending outwardly from and connected to sidewalls 44 are four fan tiers 50, 52, 54 and 56, respectively, with each tier having a plurality of fins for transferring heat from sidewalls 44 that have been heated by fumes from fire 36. It is preferred that first fan tier 50 has four fins 58, second fan tier 52 has four fins 60, third fan tier 54 has four fins 62 and fourth fan tier 56 has four fins 64. To urge the air being heated into a flow around chimney 50 and thereby assist in heat transfer from the plurality of fins, each of the four fins 58, 60, 62 and 64 is constructed to have a curved surface 66 that forms an angle Θ between its tangent and a plane formed for each fan tier. When desired, angle Θ changes with each fan tier to further assist in heat transfer as the air flows from base 46 to outlet 48 of chimney 40.

Figure 3:
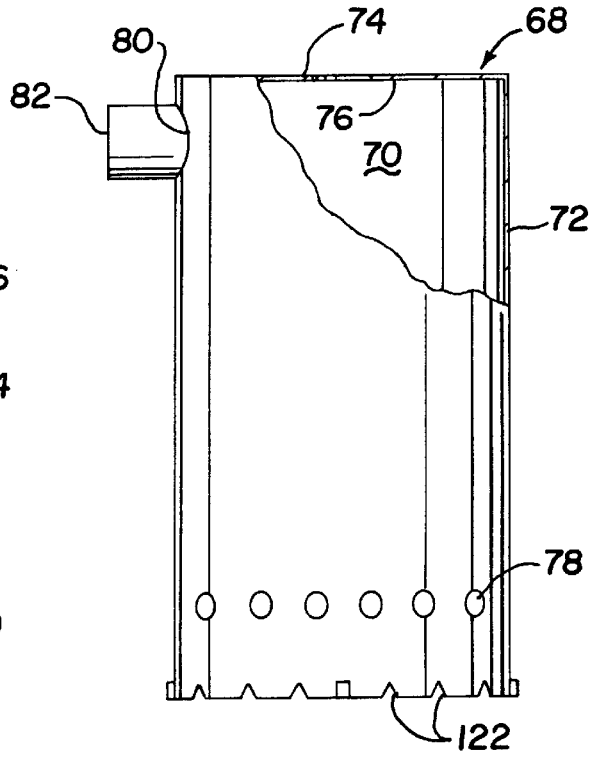
FIG. 3 is a view, in elevation and partly in section, of a sleeve used to contain the heat transfer portion the apparatus shown in FIG. 2.

As best seen in FIGS. 1 and 3, a sleeve 68 for containing a quantity of air 70 is detachably connected to and disposed around chimney 40 outwardly of the plurality of fins 58, 60, 62 and 64. Sleeve 68 has sidewalls 72 in the shape of a tube and a top 74 blocking the tube. Sidewalls 72 and top 74 create an interior 76 that, along with chimney 40 and the plurality of fins 58, 60, 62 and 64 define and contain quantity of air 70. A plurality of ambient air inlets 78 disposed in fluid communication with interior 76 are disposed around sidewalls 72 and at an end away from top 74 for allowing quantity of air 70 to be continuously supplemented. A heated air outlet 80 for allowing the quantity of air 70 to be continuously exhausted is disposed through sidewalls 72 in fluid communication with interior 76. A tube 82 extends outwardly of sidewalls 72 around heated air outlet 80.

Transporting apparatus 84 is used to transport the heated air from heat transfer device 34 to interior heater 18. Transporting apparatus 84 has an elongated tube 86 with a length sufficient to extend between first location 20 and second location 38. Elongated tube 86 has a first end 88 connected by a coupler 90 to tubular member 82, which is disposed around heated air outlet 80 of sleeve 68, and a second end 92 connected by a coupler 94 to interior heater 18. Tube 86 may be constructed from a single tubular element, several tubular elements or a flexible tube so long as the length is sufficient to extend between first location 20 and second location 38 and such length is maintained during use of camping apparatus 10.

A burner 96 is used to provide a continuous fire and is fed by fuel supplied by a fuel tank 98. Burner 96 and fuel tank 98 are of conventional design. When using camping apparatus 10 in a area where all of the waste material to be removed with the camper when leaving, it is preferred that fuel tank 98 support a fluid fuel, such as liquid propane or natural gas. Burner 96 is constructed to be attached to conventional outlet apparatus 100 on tank 98 so that fluid communication may exist between burner 96 and tank 98. Burner 96 is selected to burn the fluid at an optimum rate. Burner 96 and tank 98 have axes of symmetry that are disposed coincident to one another with properly connected by connecting apparatus 100.

Connector apparatus 102 is used to connect burner 96 and tank 98 to heat transfer device 34. Connector apparatus 102 includes a tubular connecting sleeve 103 with an axis of symmetry and with a size sufficient to encircle burner 96 and a portion of tank 98. A positioning apparatus 104 is used to center the axes of symmetry of burner 96 and tank 98 to be coincident with axis of symmetry 42. Positioning apparatus 104 includes at least three screw members 106, preferably four screw members 106, threadedly connected to sleeve 103. Each screw member 106 has a contacting end 108 with an engaging pad 110 for engaging tank 98 disposed inwardly of sleeve 103 and an outside end 112 that has a hand wheel 114 connected thereto for urging engaging pad 110 into and out of engagement with tank 98 when rotated. By proper positioning of tank 98 in sleeve 103 and proper manipulation of hand wheels 114, the axes of symmetry of burner 96 and tank 98 are disposed to lie coincident with axis of symmetry 42.

As best seen in FIG. 1, to provide adequate air to be provided to fire 36, apertures 116 are provided in sleeve 103 at an elevation beneath fire 36 and burner 96. It is preferred that four apertures 116 be used and that they be disposed in a radial fashion equally around sleeve 103.

An intermediate member 118 constructed in the shape of a truncated cone is disposed between and interconnects base 46 of chimney 40 to the top of sleeve 103.

Four upwardly extending connecting members 120 are connected to the top of sleeve 103 to support sleeve 68 when positioned around fins 36 and chimney 40. Although three connecting member 120 may be used to support sleeve 68 on sleeve 103, it is preferred that four members 120 be used to provide additional support. In either event, it is preferred that members 120 be disposed in a radial fashion equally around sleeve 103.

To allow fluids, which may flow through ambient air inlets 78 into interior 76 of sleeve 68, to drain from the connection between sleeve 68 and sleeve 103, notches 112 are provided in the lower surface of sidewalls 44, as shown in FIG. 3.

To provide heat to interior 12 of portable habitation 14, first location 20 to place portable habitation 14 is chosen. The minimum distance from first location 14 where fire 365 may be used outside of which fire 36 will not spread to portable habitation 14 is determined. Fuel tank 09 is positioned at second location 38, which is outside of the determined minimum distance. Burner 96 is attached to fuel tank 98. Chimney 40 is mounted over burner 96. First end 88 of transporting apparatus 84 is connected to sleeve 68 and second end 92 of transporting apparatus 84 is connected to heat transfer device or heater 18 in portable habitation 14. Fire 36 is started on burner 96. Air passes through apertures 116 while fuel is being burned by burner 98. Fan 26 is provided in heat transfer device 18 in portable habitation 14. Fan 26 is activated to draw heated air through transporting apparatus 84 and ambient air into sleeve 68. Burner 96 is adjusted to provide an optimum fire at fire 36.

The invention having been described, what is claimed is:

1. Apparatus for heating an interior of a portable habitation, comprising: an interior heater for heating the interior of the portable habitation; a heat transfer device for using fumes emitted by a fire to provide heated air; and transporting apparatus for transporting the heated air from said heat transfer device to said interior heater, said interior heater being disposed at a first location and the fire being disposed at a second location, the first and second locations being disposed sufficiently apart from one another to prevent the fire at the second location from spreading to the portable habitation at the first location, and said transporting apparatus including a length sufficient to extend between the first and second locations; a burner for providing a continuous fire fed by fuel supplied by a fuel tank; and a connector for connecting said burner to said heat transfer device, said connector further including positioning apparatus for centering said burner relative to a center of said heat transfer device.

2. The apparatus set forth in claim 1, further comprising: the positioning apparatus including at least three screw members threadedly connected to and disposed to extend inwardly to engage the fuel tank.

3. Apparatus for heating an interior of a portable habitation, comprising: an interior heater for heating the interior of the portable habitation; a heat transfer device for using fumes emitted by a fire to provide heated air; and transporting apparatus for transporting the heated air from said heat transfer device to said interior heater, said interior heater being disposed at a first location and the fire being disposed at a second location, the first and second locations being disposed sufficiently apart from one another to prevent the fire at the second location from spreading to the portable habitation at the first location, and said transporting apparatus including a length sufficient to extend between the first and second locations, said heat transfer device including a chimney for transporting fumes emitted by the fire away from the fire, fins for transferring heat from the fumes connected to and extending away from the chimney and a sleeve for containing a quantity of air detachably connected to and disposed around the chimney outwardly of the fins.

4. The apparatus set forth in claim 1, further comprising: the chimney being constructed with sidewalls tapering toward one another away from the fire.

5. The apparatus set forth in claim 3, further comprising: each of the fins being constructed to have a curved surface for urging the air being heated in the sleeve into a flow around the chimney.

6. The apparatus set forth in claim 3, further comprising: the sleeve of said heat transfer device including an interior to contain the quantity of air, an air inlet for allowing the quantity of air to be continuously supplemented disposed in fluid communication with the interior and a heated air outlet for allowing the quantity of air to be continuously exhausted disposed in fluid communication with the interior.

7. The apparatus set forth in claim 6, further comprising: said transporting apparatus including a elongated tube connected to the heated air outlet of the sleeve.

8. The apparatus set forth in claim 6, further comprising: said transporting apparatus including a elongated tube connected to the heated air outlet of the sleeve.

9. The apparatus set forth in claim 6, further comprising: each of the fins being constructed to have a curved surface for urging the air being heated in the sleeve into a flow around the chimney.

10. The apparatus set forth in claim 6, further comprising: a burner adapted to be connected to a fuel tank; and a connector for connecting said burner to said heat transfer device.

11. The apparatus set forth in claim 10, further comprising: the chimney of said heat transfer device including a center; and said connector further including positioning apparatus for centering said burner relative to the center of the chimney.

12. The apparatus set forth in claim 11, further comprising: the positioning apparatus including at least three screw members threadedly connected to and disposed to extend inwardly to engage the fuel tank.

13. Camping apparatus for heating an interior of a portable habitation, comprising: an interior heater for heating the interior of the portable habitation, said interior heater being disposed at a first location; a heat transfer device for using fumes emitted by a fire to provide heated air, the fire being disposed at a second location, the first and second locations being disposed sufficiently apart from one another to prevent the fire at the second location from spreading to the portable habitation at the first location, said heat transfer device including a chimney for transporting fumes emitted by the fire away from the fire, the chimney including a center and being constructed with sidewalls tapering toward one another away from the fire, a plurality of fins for transferring heat from the fumes connected to and extending away from the chimney, each of the plurality of fins being constructed to have a curved surface for urging the air being heated into a flow around the chimney, and a sleeve for containing a quantity of air detachably connected to and disposed around the chimney outwardly of the fins, the sleeve including an interior to contain the quantity of air, an air inlet for allowing the quantity of air to be continuously supplemented disposed in fluid communication with the interior and a heated air outlet for allowing the quantity of air to be continuously exhausted disposed in fluid communication with the interior; transporting apparatus for transporting the heated air from said heat transfer device to said interior heater, said transporting apparatus including a length sufficient to extend between the first and second locations, and an elongated tube connected to the heated air outlet of the sleeve; a burner for providing a continuous fire fed by fuel supplied by a fuel tank; and a connector for connecting said burner to said heat transfer device, said connector including positioning apparatus for centering said burner relative to the center of the chimney, the positioning apparatus including at least three screw members threadedly connected to and disposed to extend inwardly to engage the fuel tank.

14. A method of providing heat to an interior of a portable habitation, comprising the steps of: choosing a first location to place the portable habitation; determining the minimum distance from the first location where a fire may be used outside of which the fire may be used that will not spread to the portable habitation; positioning a fuel tank at a second location chosen outside of the minimum distance; attaching a burner to the fuel tank; mounting a chimney over the burner; connecting one end of a transporting apparatus to a sleeve and another end of the transporting apparatus to a heat transfer device in the portable habitation; starting a fire on the burner; and passing air through the sleeve while fuel is being burned by the burner.

15. The method set forth in claim 14, further comprising the steps of: providing a fan in the heat transfer device in the portable habitation; activating the fan to draw air through the transporting apparatus and sleeve.

16. The method set forth in claim 14, further comprising the steps of: adjusting the burner to provide an optimum fire at the fire.

* * * * *